United States Patent [19]

Bloch et al.

[11] 4,071,870

[45] Jan. 31, 1978

[54] APPARATUS TO GENERATE MINIMALLY DELAYED INSTRUCTIONS FOR TURBINE VALVES IN THE EVENT OF POWER SYSTEM SHORT CIRCUITS

[75] Inventors: Heinz Bloch, Nussbaumen; Ernst Wirth, Baden, both of Switzerland

[73] Assignee: BBC Brown, Boveri & Company Limited, Baden, Switzerland

[21] Appl. No.: 561,693

[22] Filed: Mar. 25, 1975

[30] Foreign Application Priority Data

May 31, 1974 Switzerland ..... 07489/74

[51] Int. Cl.[2] ..... H02H 7/06

[52] U.S. Cl. ..... 361/21; 361/33; 290/40 R; 322/23

[58] Field of Search ..... 317/21, 19, 13 R, 20, 317/22, 32; 322/18, 23, 28, 29, 38, 21; 290/2, 4 R, 40, 52; 60/660; 137/51, 47; 361/20, 21, 30, 23, 33

[56] References Cited

U.S. PATENT DOCUMENTS

| | | | |
|---|---|---|---|
| 2,832,030 | 4/1958 | Fairweather | 322/23 |
| 2,832,031 | 4/1958 | Guth | 322/23 |
| 3,238,376 | 3/1966 | Ernst et al. | 290/4 R |
| 3,421,014 | 1/1969 | Moorganov | 290/40 R |
| 3,614,457 | 6/1967 | Eggenberger | 290/40 |
| 3,643,437 | 2/1972 | Birnbaum et al. | 290/40 X |
| 3,836,822 | 9/1974 | Schonfeld et al. | 317/21 |
| 3,848,138 | 11/1974 | Park | 317/21 X |

*Primary Examiner*—J D Miller
*Assistant Examiner*—Patrick R. Salce
*Attorney, Agent, or Firm*—Pierce, Scheffler & Parker

[57] ABSTRACT

Apparatus for generating minimally delayed closing instructions for turbine valves of turbo-generator sets in the event of power system short circuits wherein major faults resulting in a drop in the system voltage are detected and act upon the valve means controlling the fluid flow to the turbine in such manner that a rapid closure of the valve means prevents the turbo-generator from falling out of step in the case of a sustained fault condition. A provisional valve-closing signal is produced upon a predetermined drop in the system voltage but this is cancelled in the event that the ensuing acceleration of the turbo-generator set does not increase to a predetermined level within two revolutions of the set.

5 Claims, 1 Drawing Figure

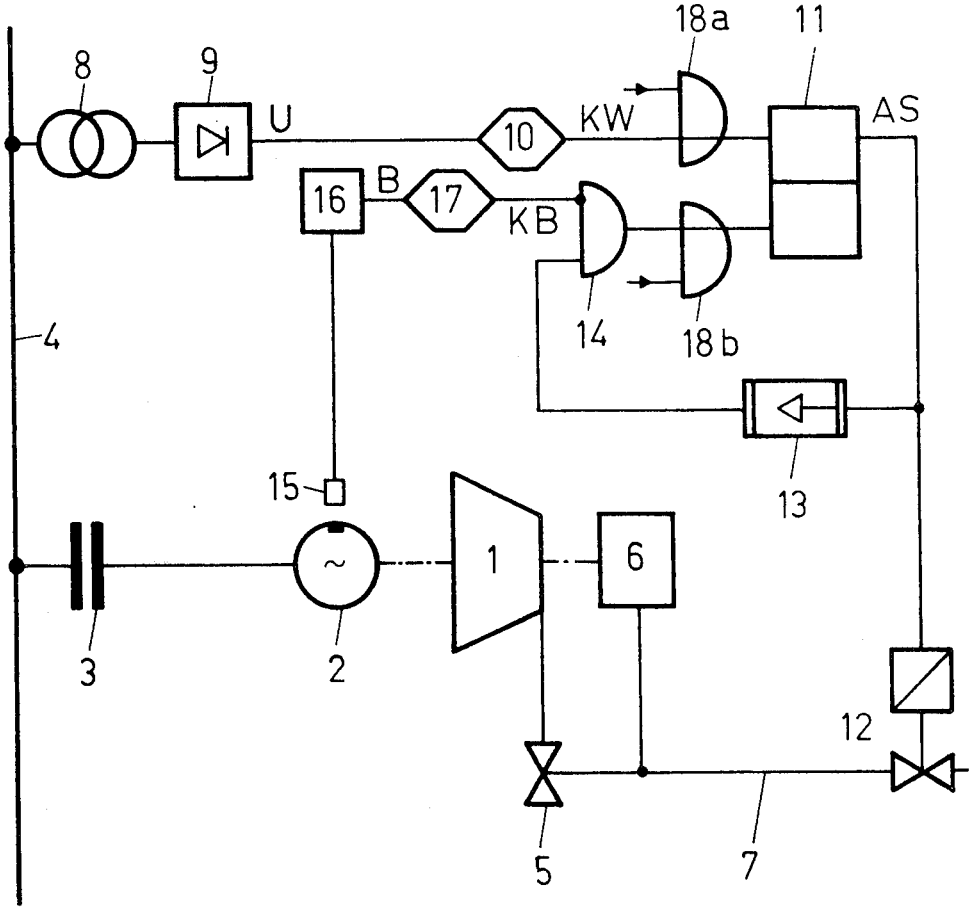
8
9
U
10
KW
18a
11
AS
16
B
17
KB
14
18b
4
13
15
1
6
3
2
12
5
7

APPARATUS TO GENERATE MINIMALLY DELAYED INSTRUCTIONS FOR TURBINE VALVES IN THE EVENT OF POWER SYSTEM SHORT CIRCUITS

The present invention relates to an improved apparatus for generating minimally delayed closing instructions for turbine valves of turbo-generator sets in the event of power system short circuits whereby major faults, in particular short circuits in the power transmission system, are detected and act on the control system of the turboset in such a way that rapid closure of the turbine valves prevents the turbo-generator from falling out of step during or after the fault, whereas closing instructions are not initiated by insignificant faults of very short duration, and thus the energy balance in the power system is not disturbed.

When short circuits occur in electrical power distribution systems, the voltage collapses and in consequence the energy transported decreases, although the currents rise sharply. As a result, the equilibrium between mechanical driving torque and electrical braking torque at the affected energy sources (turbosets) is destroyed and the rotors of the machines accelerate. Depending on the duration of the short circuit, the rotor displacement angle of the generating unit closest to the short circuit relative to the remainder of the power system can then attain such a value that this unit falls out of step, despite elimination of the short circuit and rapid reclosure. If at the instant the short circuit occurs the driving torque of the turboset is reduced quickly by closing the turbine valves fast and with as little as delay as possible, a short circuit of longer duration can be tolerated without loss of synchronism. To put this method, known in the American literature as "fast valving" or "early valving", successfully into practice, it is essential that a. an unambiguous criterion with minimum delay is available to trip the closing instruction
b. the valves throttle the supply of steam to the turbine quickly in response to the closing instruction The "fast valving" method is described, for example, in the book "Power System Stability" by S. B. Crary (Wiley Sons Inc. New York 1945/1947), p. 195 et seq.

The object of the invention is to provide an improved apparatus for generating minimally delayed criteria for reducing the turbine driving torque. The following criteria for initiating the closing instruction have been considered in the past:

1. Comparison of the mechanical driving power of the turbine (measured in terms of the approximately proportionate steam pressure before the intermediate-pressure section) with the generator current and/or the electrical power sent out.
2. Evaluation of a jump in the electrical power sent out.
3. Evaluation of the acceleration from the rotational speed of the turborotor.

It is the purpose of the invention to detect major faults, in particular short circuits in the power transmission system, and to influence the control system of the turboset in such a way that by closing the turbine valves quickly the turbo-generator is prevented from falling out of step during or after the fault. Since with "fast valving" the permissible short-circuit duration can be extended by a few periods at the most, it is of vital importance that tripping should take place within approximately one period. On the other hand, "fast valving" must not also be initiated by insignificant faults of very short duration, which would otherwise disturb the power balance in the transmission network.

In the following it is assumed that the considered steam turbosets incorporate speed regulators with acceleration limiters to control the overspeed on load rejection (as is the case with the machines of the applicant), so that restraining the speed when load is disconnected plays only a secondary role.

In the case of the known devices which compare the mechanical power of the turbine with the power sent out by the generator, or evaluate the step increase in power, the lower limit of the response delay is determined by the time constant of the power measuring transducer. Versions with time constants shorter than 0.1 s are not known. Such time lags must also be expected with devices which evaluate the generator current, since currents are measured with similar transducers. Equally, rectification to produce the current measurement is of no benefit because, owing to the direct-current components of the short-circuit current, even multiple-phase rectification is accompanied by a large power-frequency component, and elimination of this by means of filters again gives rise to corresponding time lags.

When measuring the acceleration of the turborotor a substantial delay must be expected for purely physical reasons: In a synchronous generator, such high losses occur at the beginning of a three-phase short circuit that the rotor displacement angle and speed at first decrease and the acceleration becomes negative (the so-called back-swing effect). A definitely positive acceleration can be detected only after 2 periods (40 msec), the more so when the speed contains a strong power-frequency component.

With the known devices, no mention is made of measures against unnecessary or erroneous tripping. At the most it is stated that previous identification of the nature of the fault would be desirable, but is impractical owing to the tripping delay thus incurred.

In the event of a power system short circuit the voltage collapses instantly. If the voltage is measured by suitable methods employing rectification of the secondary voltages of voltage transformers, e.g. with three-phase push-pull rectification, owing to its small residual ripple (e.g. 5%) this measured value can be evaluated as an absolute value, step change or gradient without the need for filtering, or with a minimum of filtering. The criterion obtained in this manner thus has virtually no delay with respect to the beginning of the short circuit.

With non-delayed criteria there is, owing to their very nature, a greater probability of spurious tripping, in particular as a result of transients within the time range of the system and transformer time constants. To avoid this, it is proposed in accordance with the invention that evaluation of the measured voltage is combined with detection of the rotor acceleration, with account taken of the not insignificant dead time of the valve servomotors, in such a way that when the measured voltage falls below a limit value (or decreases by more than a certain amount below its value before the fault, as stored by a delay device), a provisional instruction for the turbine valves to close is initated immediately, this instruction acting on the hydraulic control system of the turbine via an electrohydraulic converter, that the acceleration is determined with a device which measures the time difference between two successive revolutions of the turbine shaft and the acceleration criterion is generated by means of comparison with a limit value, and that immediately an unambiguous acceleration criterion is detected the provisional closing instruction initiated by the voltage criterion becomes effective for an unlimited length of time, while conversely, if no acceleration criterion is generated within a predetermined time after appearance of the voltage criterion, the provisional closing instruction is cancelled.

In this way, therefore, despite the swing-back effect, a reliable, unambiguous acceleration criterion can be generated within at most two revolutions after a short circuit. In this event the closing instruction initiated by the voltage criterion is sustained. Otherwise, i.e., if no acceleration criterion is present within about 40–50 ms after appearance of the voltage criterion, the closing instruction is cancelled. Owing to the dead time, the valves will not have moved perceptibly during this time, and therefore a case of spurious tripping will be of no consequence.

The invention will now be explained in more detail with reference to the following detailed description of a preferred embodiment thereof and the accompanying drawing, the single view of which is a schematic diagram of a turbo-generator set connected to a power system and with the valving to the turbine component controlled as a function of the two parameters of a voltage change on the system and acceleration of the turbo-generator set.

With reference now to the drawing, a steam turbine 1 is seen to be shaft-coupled to an electrical generator 2 which is coupled by way of transformer 3 to the high-voltage system 4. The steam supply to the turbine is regulated with valves 5 by turbine controller 6 via the hydraulic control system 7.

The voltage in the high-voltage system is converted to a measured voltage via instrument transformer 8 and multiple-phase rectifier 9. The limit-value generator 10 in the form of a voltage discriminator passes a "set" instruction KW to the memory 11 if $U < U_1$. The output signal AS of the memory then actuates the solenoid valve 12, which lowers the pressure in the hydraulic control system to such an extent that the valves close completely or partially. The signal AS is also fed via an delay element 13 to the direct input of AND gate 14.

The speed of the turborotor is measured by sensor 15 and passed to the evaluation device 16. This measures the time difference between two consecutive revolutions of the turbine shaft, and from this determines the instantaneous value B of the acceleration, which triggers the signal KB in the limit-value generator 17 if B is greater than a preset limit value $B_1$. This signal KB is fed to the inverting input of the AND gate 14. The output of this AND gate leads to the reset input of the memory 11 which is thus reset if, following the delay time of 13, the acceleration signal B is smaller than the limit value $B_1$.

The OR gate **18*a* interposed in the signal path between the output of limit-value generator 10 and the set input to memory 11, and the OR gate 18*b* interposed in the signal path between the output of AND gate 14 and the reset input to memory 11** allow additional signals to be introduced to actuate the appropriate functions "set" and "reset".

As an alternative, the limit-value generator 10 in the form of purely a voltage discriminator can be replaced, or supplemented, by a device (voltage jump detector) which responds only to step changes in the input quantity U and thus sets the memory 11 in the event of a step reduction of voltage $U > U_1$ with criterion KW.

We claim:

1. The combination with a turbo-set comprising a turbine shaft coupled to an alternating current electrical generator whose output is delivered to a high-voltage power system and wherein valve means are provided for controlling the fluid flow to said turbine of an improved arrangement for effecting a rapid closure of said valve means with minimally delayed closing instructions in the event of a sustained major fault on said power system which comprises;

means producing a first provisional signal upon a predetermined drop in the network voltage and which is passed to said valve means for commencing a closing operation of said valve means, means producing a second signal having a level indicative of the acceleration of the turbine shaft within two revolutions thereof following the drop in network voltage, and means responsive upon a failure of said second signal to reach a predetermined level for cancelling out said first signal thereby terminating the closing operation of said valve means.

2. The combination with a turbo-set comprising a turbine shaft coupled to an alternating current electrical generator whose output is delivered to a high-voltage power system and wherein valve means are provided for controlling the fluid flow to said turbine of an improved arrangement for effecting a rapid closure of said valve means with minimally delayed closing instructions in the event of a sustained major fault on said power system which comprises:

means for measuring the network voltage, means comparing said measured network voltage with a reference limit voltage and which produces a first provisional valve closing signal when said measured network voltage falls below said reference limit voltage by a predetermined amount, a memory to the set input of which said first provisional valve-closing signal is fed, means for measuring the acceleration of said turbine shaft within two revolutions thereof, means comparing said measured turbine shaft acceleration with a reference limit value of acceleration and which produces a second signal when said measured turbine shaft acceleration exceeds said reference acceleration, means for actuating said valve means to a closed position and which are connected to the output signal from said memory, an AND gate having direct and inverting inputs, means connecting the output signal from said memory through a delay unit to the direct input of said AND gate, means connecting said second signal to the inverting input of said AND gate, and means connecting the output from said AND gate to the reset input of said memory.

3. Apparatus as defined in claim 2 wherein said means comparing said measured network voltage with a reference limit voltage is constituted by a pure voltage discriminator from which said first provisional valve closing signal is fed to the set input of said memory.

4. Apparatus as defined in claim 2 wherein said means comparing said measured network voltage with a reference limit voltage is constituted by a voltage step-change detector which responds only to a step wise reduction in network voltage that exceeds a predetermined value thereby to produce said first provisional valve closing signal which is fed to the set input of said memory.

5. Apparatus as defined in claim 2 and which further includes an OR gate through which said first provisional valve closing signal is fed to the set input of said memory and a second OR gate through which the output from said AND gate is fed to the reset input of said memory.

* * * * *